US007085721B1

(12) United States Patent
Kawahara et al.

(10) Patent No.: US 7,085,721 B1
(45) Date of Patent: Aug. 1, 2006

(54) METHOD AND APPARATUS FOR FUNDAMENTAL FREQUENCY EXTRACTION OR DETECTION IN SPEECH

(75) Inventors: Hideki Kawahara, Kainan (JP); Toshio Irino, Kyoto (JP)

(73) Assignee: Advanced Telecommunications Research Institute International (JP)

( * ) Notice: Subject to any disclaimer, the term of this patent is extended or adjusted under 35 U.S.C. 154(b) by 971 days.

(21) Appl. No.: 09/786,642

(22) PCT Filed: Jul. 5, 2000

(86) PCT No.: PCT/JP00/04455

§ 371 (c)(1),
(2), (4) Date: Mar. 7, 2001

(87) PCT Pub. No.: WO01/04873

PCT Pub. Date: Jan. 18, 2001

(30) Foreign Application Priority Data

Jul. 7, 1999 (JP) ..... 11-192437

(51) Int. Cl.
*G10L 13/00* (2006.01)
*G10L 19/06* (2006.01)

(52) U.S. Cl. ..... 704/258; 704/205; 704/209

(58) Field of Classification Search ..... 704/233, 704/204–206, 209, 2–9, 258
See application file for complete search history.

(56) References Cited

U.S. PATENT DOCUMENTS 4,885,790 A * 12/1989 McAulay et al. ..... 704/265
5,054,072 A * 10/1991 McAulay et al. ..... 704/207
5,570,305 A * 10/1996 Fattouche et al. ..... 708/203
5,696,874 A * 12/1997 Taguchi ..... 704/219
5,812,737 A * 9/1998 Wang ..... 704/207
6,067,511 A * 5/2000 Grabb et al. ..... 704/223
6,078,880 A * 6/2000 Zinser et al. ..... 704/208
6,081,776 A * 6/2000 Grabb et al. ..... 704/219
6,098,036 A * 8/2000 Zinser et al. ..... 704/219

(Continued)

OTHER PUBLICATIONS

Jones et al, "Instantaneous frequency, instantaneous bandwidth and the analysis of multicomponent signals", ICASSP-90, Apr. 3-6, 1990, pp. 2467-2470, vol. 5.*

(Continued)

*Primary Examiner*—David L. Ometz
*Assistant Examiner*—Michael N. Opsasnick
(74) *Attorney, Agent, or Firm*—Lorusso & Loud

(57) ABSTRACT

An object is to provide a method of extracting sound-source information, which method enables the characteristics of fixed points of mapping from filter center frequency to output instantaneous frequency to be detected from instantaneous data, as a value which can be interpreted quantitatively. In a method of extracting sound-source information by use of fixed points of mapping from frequency to instantaneous frequency, instantaneous frequency of each filter (2), (9) is partial-differentiated with respect to frequency by an instantaneous-frequency frequency differentiation circuit (3), (10) to thereby obtain a first value; output of each filter is partial-differentiated with respect to frequency and then with respect to time by an instantaneous-frequency time-frequency differentiation circuit (4), (11) to thereby obtain a second value; and proper weights are imparted to the first and second values and short-time weighted integration with respect to time is performed by a carrier-to-noise-ratio calculation circuit (5), (12) to estimate a carrier-to-noise ratio of each filter. Thus, a carrier-to-noise ratio is obtained, and an estimated value of evaluation value is obtained.

6 Claims, 14 Drawing Sheets

U.S. PATENT DOCUMENTS

| | | | | |
|---|---|---|---|---|
| 6,119,082 | A * | 9/2000 | Zinser et al. | 704/223 |
| 6,138,092 | A * | 10/2000 | Zinser et al. | 704/223 |
| 6,185,309 | B1 * | 2/2001 | Attias | 381/94.1 |
| 6,204,735 | B1 * | 3/2001 | Cairns | 332/119 |

OTHER PUBLICATIONS

Arnold et al, "Filtering real signals through frequency modulation and peak detection in the time-frequency plane", ICASSP 1994, vol. iii Apr. 19-22, 1994, pp. 345-348.*

Yang et al, "Application of instantaneous frequency estimation for fundamental frequency detection", IEEEE-SP Oct. 25-28, 199; pp. 616-619.*

Abe et al, "Harmonics tracking and pitch extraction based on instantaneous frequency", ICASSP-1995, May 9-12, 1995; pp. 756-759.*

Potamianos et al, "Speech formant frequency and bandwidth tracking using multiband energy demodulation", ICASSP-95, May 9-12, 1995, vol. 1, pp. 784-787.*

Angeby, "Structure Autoregressive instantaneous phase and frequency estimation", ICASSP 1995, vol. 3, May 9-12, 1995, pp. 1768-1771.*

Armin, "Interference mitigation in spread spectrum communication systems using time-frequency distributions", IEEE Transactions on Acoustics, Speech, and Signal Processing; vol. 45, Jan. 1, 1997; pp. 90-101.*

Dandapat et al, "Midprediction error filtering approach to the detection of glottal closing instants", Proceedings of the 18th Annual Conference of the IEEE, vol. 4 Oct. 3, 1996; pp. 1528-1529.*

Boashash et al, "Instantaneous frequency estimation and automatic time-varying filtering", ICASSP 1990, Apr. 3-6, 1990; pp. 1221-1224.*

Riba-Sagarra et al, "Recursive Bayes risk parameter estimation from the cyclic autocorrelation matrix", ICASSP-1994; vol. iv, Apr. 19-22, 1994; pp. 409-412.*

Grbic et al, "Blind signal separation using overcomplete subband representation", IEEE Transactions on Speech and Audio Processing, vol. 9 issue 5, Jul. 2001 pp. 423-533.*

Arnold, "Spectral Estimation for transient waveforms", IEEE Transactions on Audio and Electroacoustics, vol. 18, issue 3, Sep. 1970; pp. 248-257.*

Martens et al, "An auditory model based on the analysis of envelope patterns", ICASSP 1990, Apr. 3-6, 1990; pp. 401-404.*

Varho et al, "A linear predictive method using extrapolated samples for modelling of voiced speech", IEEE ASSP Workshop, Oct. 19-22, 1997;pp. 1-4.*

Capdevielle et al, "Blind separation of wide-band sources in the frequency domain", ICASSP 1995, vol. 3 May 9-12, 2005; pp. 2080-2083.*

Youn et al, "Short-time Fourier transform using a bank of low-pass filters", IEEE Transactions on Acoustics, Speech, and Signal Processing; vol. 33 Feb. 1985; pp. 182-185.*

* cited by examiner

METHOD AND APPARATUS FOR FUNDAMENTAL FREQUENCY EXTRACTION OR DETECTION IN SPEECH

TECHNICAL FIELD

The present invention relates to a method of extracting sound-source information.

BACKGROUND ART

Instantaneous frequency is a concept which has been naturally expanded from the concept of frequency to any signals that change with time. Instantaneous frequency has many characteristics suitable for representation of a nonstationary signal such as a voice signal. The characteristics have been applied to signal processing of various types: (1) voice coding on the basis of a sinusoidal-wave model, (2) Formant extraction and band-width estimation, (3) extraction of the harmonic structure of voiced sound, (4) extraction of a fundamental frequency, and (5) interesting computation model for auditory information processing. Hereinafter, the frequencies, phases, and fundamental frequencies of component sinusoidal waves of a sinusoidal-wave model; their strengths in terms of periodicity (or the ratio between periodic components and aperiodic components); etc. are collectively referred to as "sound-source information." However, important potentialities of this concept; in particular, extraction of sound-source information of speech sound, has not yet been studied sufficiently. Recent studies in this aspect have revealed that use of instantaneous frequency leads to a considerably excellent method for extracting sound-source information.

In the case in which a conspicuous sinusoidal-wave component is present in a passband common among a plurality of bandpass filters having different center frequencies, the outputs of the bandpass filters have been known to assume a substantially constant instantaneous frequency. In other words, mapping from filter center frequency to output instantaneous frequency yields a fixed point in the vicinity of the conspicuous signal frequency. This property is used for extraction of conspicuous resonance such as harmonic components of complex sound and Formant of speech sound. Further, it has been pointed out that this property is related to the phenomenon of synchronous ignition between different auditory nerves; and modeling by "synchrony strand" has been developed as a model for representing a corresponding auditory entity. However, there has not been a clear idea to integrate these thoughts into a consistent F0 extraction method.

The present inventor has recently proposed a high-quality system for analysis, conversion, and synthesis of voice, called "STRAIGHT." STRAIGHT is obtained through refining the concept of a classical channel vocoder on the basis of generalized pitch synchronization analysis. In the present specification, the conventionally-used term "pitch synchronization analysis" is used. In the field of voice information processing, the term "pitch" is used to express the same meaning as that of fundamental frequency (F0). However, this is inaccurate use of the term. F0, which represents a physical attribute, is essentially different from pitch, which represents a psychological attribute. In the present specification, the term "pitch" is not used, except for the case in which psychological attributes are mentioned. In the STRAIGHT method, since analysis adapted for F0 is performed, accurate and reliable F0 information is needed for each fundamental period of voiced sound, which is defined to be a single open/close cycle of the glottis. The inventor carried out studies while applying various conventionally-proposed F0-extraction methods and as a result found that conventional methods cannot satisfy the requirement on temporal resolution and the requirement on frequency accuracy. Further, the inventor found that in the case in which an extracted F0 contains a discontinuous component or a component that varies at high speed, the perceptual quality of voice synthesized on the basis of the F0 information deteriorates, even if the absolute values of the components are small. Moreover, the inventor found that judgment of unvoiced sound/voiced sound greatly affects synthesis of perceptually high-quality voice, and in some cases, temporal accuracy of a few milliseconds or less is demanded. Also, it was found that when a bias in a particular direction is not present, a trend component which gradually changes the F0 has no adverse perceptual influence on synthesized voice.

Heretofore, many FO-extraction methods and apparatus have been proposed: time domain algorithm on the basis of interval measurement, frequency-domain method on the basis of spectrum, a method in which autocorrelation and harmonic sieve (sieve for extracting harmonic components) are used singly or in combination, and a biologically-motivated method. These methods and apparatus premise that a signal to be analyzed is a periodic signal from the viewpoint of mathematics. In each of these methods and apparatus, a value estimated on the basis of periodicity from the viewpoint of mathematics provides a correctly estimated FO value for a signal whose FO is constant over time. However, it is not clear whether conventional methods and apparatus can provide correctly estimated FO values in analysis of a real voice, where FO changes with time, or in analysis of complex sound in which the frequencies of sinusoidal-wave components deviate slightly from a harmonic relation.

In the proposed high-quality voice conversion system, conversion and re-synthesis of voice must be performed on the basis of accurate sound-source information of an original voice. Therefore, in order to improve this method, an FO-extraction method can rationally be applied to a signal whose FO changes with time and a signal which includes non-harmonic components. Such an observation motivates the inventor to develop a new FO-extraction method and apparatus which produces an accurate FO locus with high temporal resolution by use of the instantaneous frequency of the fundamental component.

In the STRAIGHT method, an FO-extraction method based on instantaneous frequency has been developed and used on the assumption that a filtered signal containing a fundamental-wave component involves minimal AM modulation and FM modulation. The FO-extraction method used in the STRAIGHT method exhibited agreeable performance in an evaluation test which was performed while an EGG (Electro Glotto Graph) signal recorded simultaneously with voice was used as a reference signal. For example, in analysis of 100 sentences spoken by an adult female speaker, the error between FO obtained from voice and FO obtained from FGG became 20% or higher only in 1.4% of all analyzed frames. Further, in 53% of all analyzed frames, the FO obtained from voice fell within 0.3% of the FO obtained from FGG. However, the above-described assumption of minimal AM and FM modulation is formulated ambiguously, and the formula is not effective mathematically. Further, this method involves a problem in that standard deviation of errors of FO regarding an adult male voice becomes about double that for an adult female voice.

The present invention provides a necessary mathematical base for enabling a new FO-extraction method and apparatus, which is an expansion of the above-described method. Detailed studies on partial differentiation of a function representing the relation between a filter center frequency and an output instantaneous frequency at a fixed point were key to providing a necessary mathematical base. Thus, the present invention leads to a new consistent FO/sound-source information extraction method and apparatus which utilizes a non-stationary aspect of the concept of instantaneous frequency.

An object of the present invention is to provide a method and apparatus for extracting sound-source information, which method enables the characteristics of fixed points of mapping from filter center frequency to output instantaneous frequency to be detected from instantaneous data, as a value which can be interpreted quantitatively.

[1] In a method and apparatus for extracting sound-source information by use of fixed points of mapping from frequency to instantaneous frequency, instantaneous frequency of each filter is partial-differentiated with respect to frequency to thereby obtain a first value; output of each filter is partial-differentiated with respect to frequency and then with respect to time to thereby obtain a second value; and proper weights are imparted to the first and second values and short-time weighted integration with respect to time is performed to estimate a carrier-to-noise ratio of each filter, whereby a carrier-to-noise ratio is obtained, and an estimated value of evaluation value is obtained.

[2] In the method and apparatus for extracting sound-source information described in [1] above, on the basis of the evaluation value estimated by use of the carrier-to-noise ratio, a logarithm-frequency-axis analogous filter is used for selection of a fixed point corresponding to a fundamental frequency, and the fundamental frequency is extracted without advance information regarding the fundamental frequency.

[3] In the method and apparatus for extracting sound-source information described in [2] above, the logarithm-frequency axis analogous filter and a linear-frequency-axis analogous adapted chirp filter are used in combination in order to extract the fundamental frequency without advance information regarding the fundamental frequency and to improve the accuracy of the extracted fundamental frequency.

BEST MODE FOR CARRYING OUT THE INVENTION

An embodiment of the present invention will next be described in detail.

Figure 1:
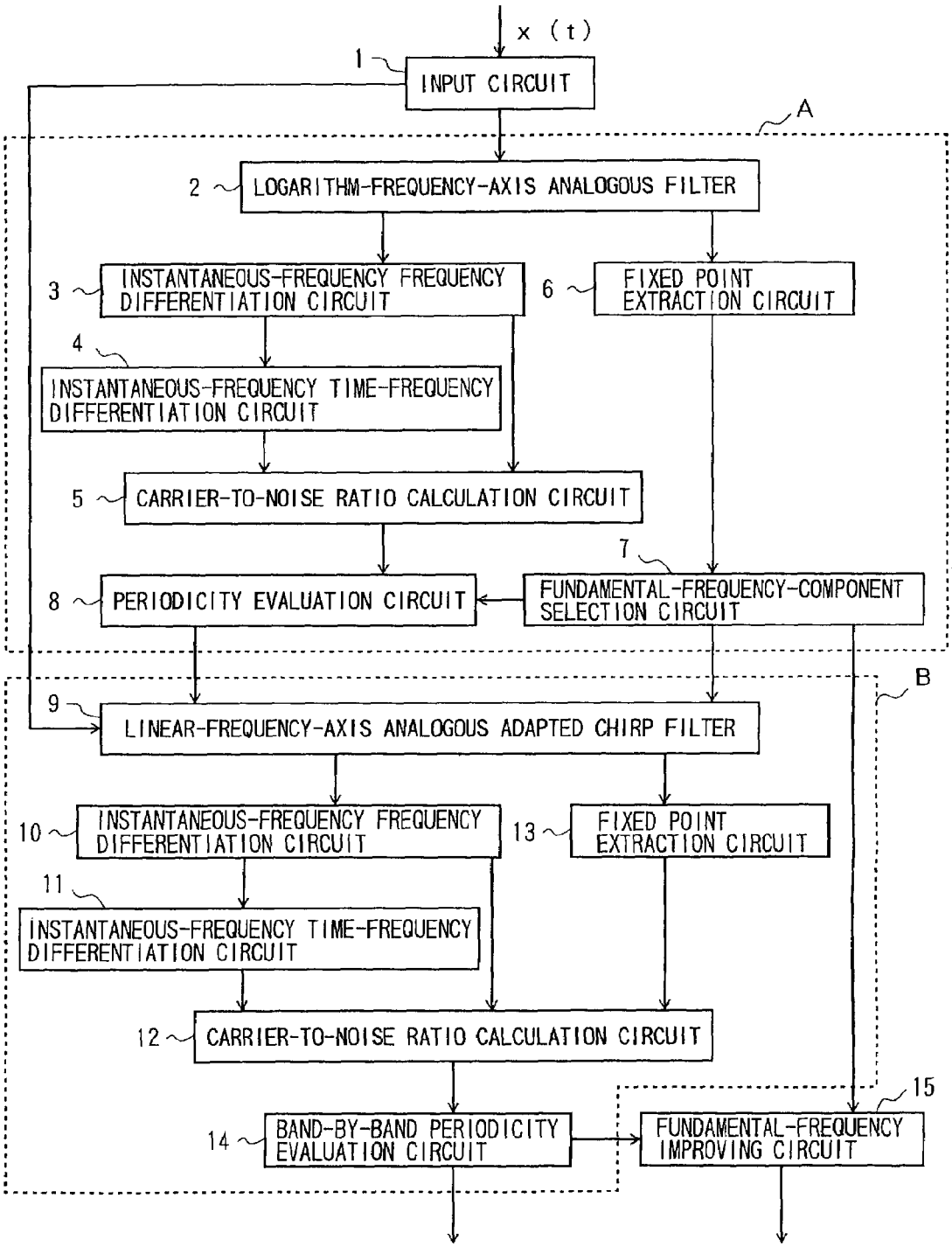
FIG. 1 is a block diagram of a fundamental-frequency extraction apparatus for extracting sound-source information according to an embodiment of the present invention.

FIG. 1 is a block diagram of a fundamental-frequency extraction apparatus for extracting sound-source information according to an embodiment of the present invention.

As shown in FIG. 1, an input circuit 1 is used for amplification, conversion, distribution, etc. of a signal x(t) to be analyzed. A voice signal collected by use of, for example, a microphone is amplified to a proper level and is digitized at a proper sampling frequency. The digitized signal is analyzed by a logarithm-frequency-axis analogous filter 2. The logarithm-frequency-axis analogous filter 2 includes a group of filters which share the same filtering profile but differ from one another in position along the frequency axis when the filter characteristics are plotted while the frequency axis is converted to logarithm and which have center frequencies systematically disposed within a range determined in accordance with the intended purpose. The systematic disposition is generally such that the center frequencies are disposed at equal intervals along the logarithm frequency axis. However, any other disposition may be employed. In an experiment performed in relation to the present invention, the center frequency was varied from 40 Hz to 800 Hz at a constant ratio such that the center frequency increased by the $24^{th}$-root of 2 (corresponding to 3%) each time. Each of the filters has an impulse response of a complex number obtained by formulae (8), (9), and (10), which will be detailed later. The output of the logarithm-frequency-axis analogous filter 2 is fed to an instantaneous-frequency frequency differentiation circuit 3 and a fixed-point extraction circuit 6.

In the instantaneous-frequency frequency differentiation circuit 3, the instantaneous frequency of output of each filter is calculated; and for each filter, partial differentiation of the instantaneous frequency with respect to frequency is performed on the basis of the instantaneous frequencies of outputs of adjacent filters and the center frequencies of the respective filters. This corresponds to formula (20), which will be described in detail later. The results of this calculation are fed to an instantaneous-frequency time-frequency differentiation circuit 4 and a carrier-to-noise ratio calculation circuit 5.

In the instantaneous-frequency time-frequency differentiation circuit 4, the value obtained for each filter through partial differentiation of the instantaneous frequency respect to frequency is differentiated with respect to time. Thus, a value is obtained through partial differentiation of each filter output with respect to frequency and then with respect to time. This corresponds to formula (22), which will be described in detail later.

The carrier-to-noise ratio calculation circuit 5 weights the value obtained for each filter through partial differentiation of the instantaneous frequency with respect to frequency and the value obtained through partial differentiation of each filter output with respect to frequency and then with respect to time, in order to perform short-time weighted integration with respect to time, to thereby calculate an estimation value of the carrier-to-noise ratio of each filter. The weights imparted to the respective partially-differentiated values are obtained by use of formula (12), which will be described in detail later, from the filtering profiles and center frequencies of the respective filters. These weights remain constant during analysis. Therefore, the weights can be determined when the filters are designed. The thus-determined weights are built in the carrier-to-noise ratio calculation circuit 5.

Figure 3:
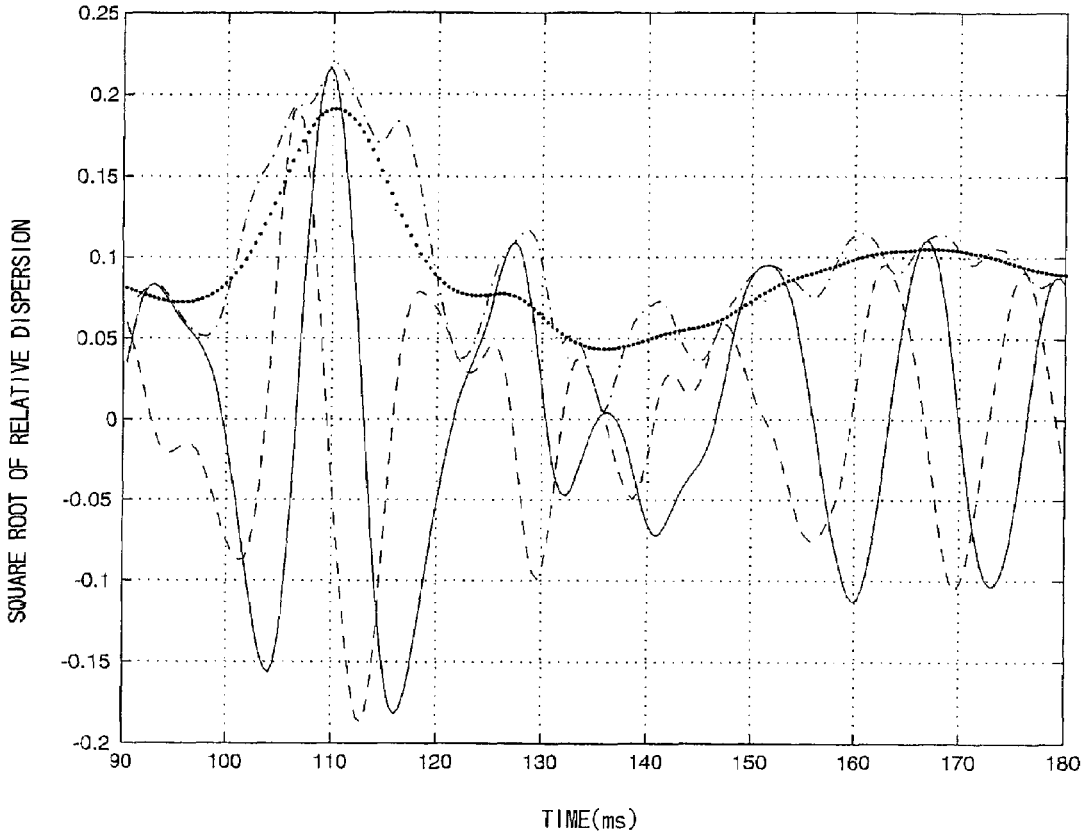
FIG. 3 is a graph relating to the embodiment of the present invention and showing intermediate and final results of calculation of carrier-to-noise ratios.

A specific example of the action of the carrier-to-noise ratio calculation circuit 5 is shown in FIG. 3, which exemplifies values obtained from an output of a certain filter which covers one sinusoidal-wave component of a signal and outputs of filters adjacent to the certain filter. The output of the instantaneous-frequency frequency differentiation circuit 3 is shown by a solid line in FIG. 3. The output of the instantaneous-frequency time-frequency differentiation circuit 4 is shown by a broken line in FIG. 3. An alternate long- and short-dashed line in FIG. 3 shows the root-mean squares of these outputs. Although this alternate long- and short-dashed line represents the overall trend (amplitude envelope) of the output of the instantaneous-frequency frequency differentiation circuit 3 and the output of the instantaneous-frequency time-frequency differentiation circuit 4, this line is difficult to use practically, because the line includes fine vibration and approaches zero at about 135 ms. The signal of the alternate long- and short-dashed line is smoothed with respect to time by use of the envelope of the impulse response of a filter under consideration. Thus, a signal indicated by a dotted line in FIG. 3 is obtained. The thus-obtained signal provides an estimated value having a high carrier-to-noise ratio.

The fixed-point extraction circuit 6 selects stable fixed points from the relation between the center frequencies of the individual filters and the instantaneous frequencies of the individual filter outputs and obtains their frequencies. The selection of fixed points is performed by use of formula (11). This circuit itself is not a feature of the present invention.

A fundamental-frequency-component selection circuit 7 compares the carrier-to-noise ratios corresponding to the individual fixed points and selects as a fundamental frequency component a fixed point corresponding to the highest carrier-to-noise ratio. Since estimation can be performed by use of carrier-to-noise ratio, which is an fundamental frequency component; the thus-created signal is analyzed in the same manner as that used for analyzing the original signal, in order to obtain the carrier-to-noise ratio of the created signal; and the carrier-to-noise ratio of the created signal is subtracted from that of the original signal to obtain aperiodic components, which are then evaluated.

Only the above-described portion; i.e., the portion surrounded by a broken line A in FIG. 1, can be used satisfactorily as a high-accuracy sound-source information analyzer.

However, when the portion which will be described hereinbelow; i.e., the portion surrounded by a broken line B in FIG. 1, is added, the accuracy of the sound-source information analyzer can be improved further.

Figure 8:
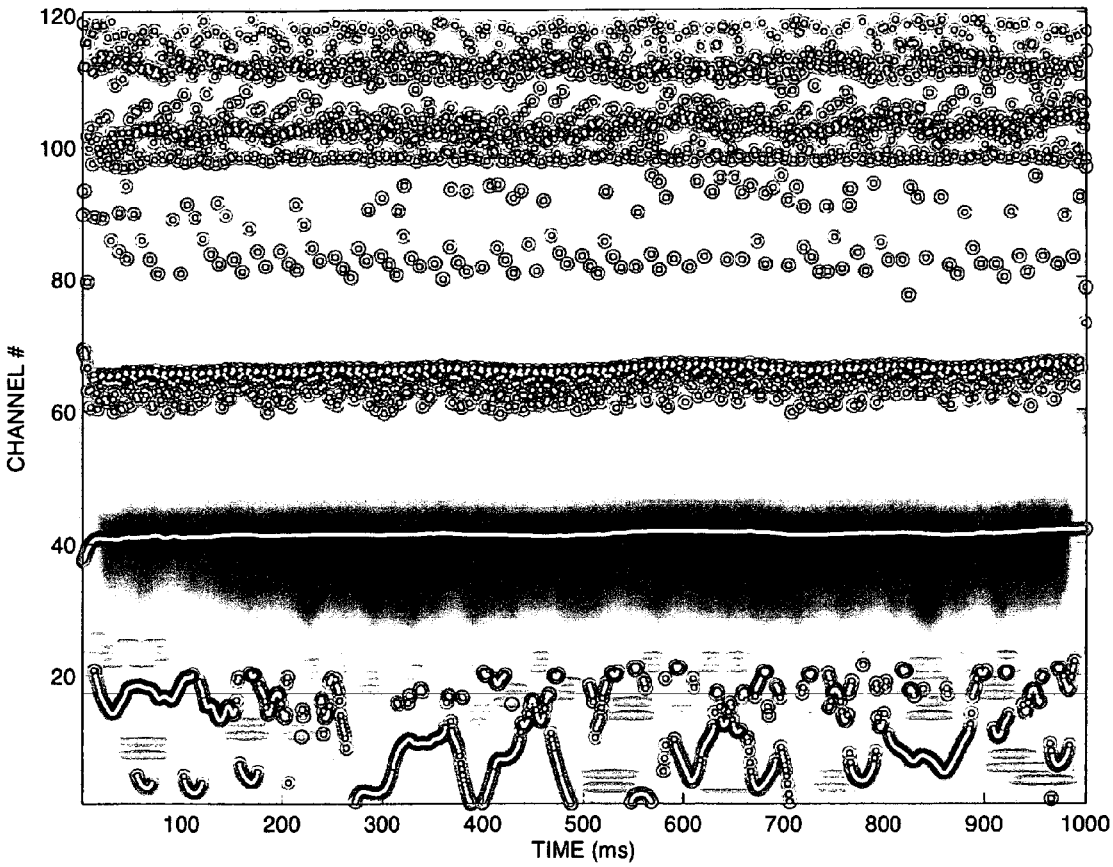
FIG. 8 is a photograph relating to the embodiment of the present invention and showing distributions of carrier-to-noise ratios and fixed points on a time-channel plane.

A linear-frequency-axis analogous adapted chirp filter 9 determines whether the periodic component is conspicuous, on the basis of the frequency of the fundamental frequency component obtained by the fundamental-frequency-component selection circuit and the degree of periodicity obtained by the periodicity evaluation circuit, as shown in FIG. 8, which will be described later. When the periodic component is conspicuous, frequency analysis adapted for the fundamental frequency is performed. The filters used here have center frequencies equally separated along the linear frequency axis and share the same filtering profile, such that their filtering profiles would overlap one another if they were objective scale having no frequency dependency, it becomes possible to perform rational comparison among filters having different center frequencies and different filtering profiles on the linear frequency axis, such as logarithm-frequency-axis analogous filters.

A periodicity evaluation circuit 8 evaluates the degree of periodicity of the fundamental frequency component selected by the fundamental-frequency-component selection circuit 7 on the basis of the carrier-to-noise ratio corresponding to the fundamental frequency component obtained in the carrier-to-noise ratio calculation circuit 5. The periodicity evaluation circuit 8 can use three different evaluation criteria, which correspond to three different embodiments.

The first evaluation criterion is the carrier-to-noise ratio itself. That is, the signal-to-noise ratio is directly interpreted to reflect the relative amplitudes of periodic components and aperiodic components.

The second evaluation criterion is not the obtained carrier-to-noise ratio itself. Rather, the obtained carrier-to-noise ratio is corrected for estimated influences of variations in the frequency and amplitude of the fundamental frequency component; and the thus-corrected carrier-to-noise ratio is used as an evaluation criterion.

The third evaluation criterion is obtained as follows. A signal consisting of only the fundamental wave is created on the basis of the information regarding the obtained parallel-translated along the linear frequency axis. Such filters can be realized by means of high-speed Fourier transformation. Further, before performance of analysis, the time axis of the signal is converted so as to assume a parabolic shape, on the basis of variation speed of the instantaneous frequency of the fundamental frequency component, which is obtained through differentiation with respect to time of the fundamental frequency component obtained by the fundamental-frequency-component selection circuit, as shown in FIG. 8, which will be described later. Although the conversion itself has already been proposed, use of the conversion under the present configuration is new.

In the instantaneous-frequency frequency differentiation circuit 10, the instantaneous frequency of output of each filter is calculated; and for each filter, partial differentiation of the instantaneous frequency with respect to frequency is performed on the basis of the instantaneous frequencies of outputs of adjacent filters and the center frequencies of the respective filters. This corresponds to formula (20), which will be described in detail later. The results of this calculation are fed to an instantaneous-frequency time-frequency differentiation circuit 11 and a carrier-to-noise ratio calculation circuit 12.

In the instantaneous-frequency time-frequency differentiation circuit 11, the value obtained for each filter through partial differentiation of the instantaneous frequency respect to frequency is differentiated with respect to time. Thus, a value is obtained through partial differentiation of each filter output with respect to frequency and then with respect to time. This corresponds to formula (22), which will be described in detail later.

The carrier-to-noise ratio calculation circuit 12 weights the value obtained for each filter through partial differentiation of the instantaneous frequency with respect to frequency and the value obtained through partial differentiation of each filter output with respect to frequency and then with respect to time, in order to perform short-time weighted integration with respect to time, to thereby calculate an estimation value of the carrier-to-noise ratio of each filter. The weights imparted to the respective partially-differentiated values are obtained by use of formula (12), which will be described in detail later, from the filtering profiles and center frequencies of the respective filters. These weights remain constant during analysis. Therefore, the weights can be determined when the filters are designed. The thus-determined weights are built in the carrier-to-noise ratio calculation circuit 12.

A fixed-point extraction circuit 13 selects stable fixed points from the relation between the center frequencies of the individual filters and the instantaneous frequencies of the individual filter outputs and obtains their frequencies. The selection of fixed points is performed by use of formula (11). This circuit itself is not a feature of the present invention.

A band-by-band periodicity evaluation circuit 14 evaluates the degree of periodicity for the frequency band assigned to each filter, on the basis of the carrier-to-noise ratio, and outputs the same as information that represents characteristics of the respective band.

In a fundamental-frequency improving circuit 15, with reference to the rough estimation value of the fundamental frequency obtained in the fundamental-frequency-component selection circuit 7, the information regarding the frequencies of fixed points obtained in the fixed-point extraction circuit 13 and the carrier-to-noise ratio obtained in the carrier-to-noise ratio calculation circuit 12 are integrated so as to minimize the estimated average error of the final estimation value of the fundamental frequency, to thereby obtain an improved fundamental frequency.

Processing similar to the above-described processing can be performed by use of an analog circuit. In this case, the input circuit 1 has only an amplification function and a distribution function.

Hereinbelow will be described a method for extracting fixed points of mapping from frequency to instant frequency and for extracting F0 according to the embodiment of the present invention.

Here, there will be described a reliable method for extracting F0 on the basis of the features at the fixed points of mapping from filter center frequency to output instant frequency (F-IF mapping). When the impulse response of the filter envelope curve is set to be a convolution of a Gaussian signal and a quadratic cardinal B-spline base function, an estimated ratio (carrier-to-noise ratio) between a conspicuous sinusoidal-wave component (carrier component) and other components can be determined from partial differentiation of the F-IF mapping with respect to frequency and partial differentiation of the F-IF mapping with respect to time and frequency at the fixed point. When a group of filters having the same filtering profile and center frequencies separated at equal intervals along the logarithm frequency axis are used, a filter that covers the fundamental wave component can be selected while the carrier-to-noise ratio is used as a criterion. Thus, the fundamental frequency of a signal can be calculated as an instantaneous frequency of the filter output. When the proposed method was evaluated by use of a database in which voice and a corresponding EGG signal were recorded simultaneously, it was found that the number of frames whose error with respect to F0 serving as a reference is 20% or greater is less than 1% of all analyzed frames. The present invention enables tracing of the F0 locus with a time resolution as short as the fundamental period.

Now, the method of extracting sound-source information according to the present invention will be described in detail.

[1] First, in this section, a concept which is necessary for discussion in subsequent sections is introduced. First, the general view of instantaneous frequency will be described. Next, after description of the general view of a mechanism for producing voice, the advantage of the concept of instantaneous frequency in voice analysis will be described.

[1-1] Instantaneous Frequency

The instantaneous frequency $\omega(t)$ of a signal $x(t)$ is defined by use of the Hilbert transform $H[x(t)]$ of the signal.

$$s(t)=x(t)+jH[x(t)] \tag{1}$$

$$\omega(t) = \frac{d\arg[s(t)]}{dt} \tag{2}$$

where $s(t)$ is an analytic signal, and $j=\sqrt{-1}$. In order to apply this definition directly, a phase un-lapping operation is required, to remove discontinuous points stemming from indeterminacy of phase at $2n\pi$. In order to avoid such a difficulty, a number of methods which eliminate necessity of direct use of phase have been proposed.

$$s(t)=a(t)e^{j\phi(t)} \tag{3}$$

The phase component $\phi(t)$ has the following relation with the corresponding instantaneous frequency $\omega(t)$.

$$\phi(t) = \int_{t_0}^{t} \omega(\tau)d\tau + \phi(t_0) \tag{4}$$

where $\phi(t_0)$ is an initial phase at $t=t_0$.

Here, we assume that the instantaneous frequency $\omega(t)$ changes slowly and can be approximated to be a constant within a time shorter than the sampling intervals of the signal. The short-time Fourier transformation of the signal; i.e., $X(\lambda, t)$, is defined as follows.

$$X(\lambda, t) = \frac{1}{2\pi}\int_{-\infty}^{\infty} \omega(t-\tau)x(\tau)e^{j\lambda\tau}d\tau \tag{5}$$

where $\omega(t)$ represents a time window. The instantaneous frequency at each frequency point can be represented by use of two adjacent short-time Fourier transformations.

$$\omega(\lambda, t) = 2f_s \arcsin\frac{|Y_d(\lambda, t)|}{2} \tag{6}$$

$$Y_d(\lambda, t) = \frac{X(\lambda, t+\Delta t/2)}{|X(\lambda, t+\Delta t/2)|} - \frac{X(\lambda, t-\Delta t/2)}{|X(\lambda, t-\Delta t/2)|}$$

In actuality, the method proposed by Flanagan provides a higher calculation efficiency. Meanwhile, the above-described equation provides an interpretation which is conceptually simple for the instantaneous frequency of a discrete-time signal. In the equation, $\omega(\lambda, t)$ can be interpreted as the instantaneous frequency of a filter output having an impulse response $w(t)\exp(j\lambda t)$.

[1-2] Signal Model of Voice

Voiced sound is regarded to have a periodic configuration. However, variation in the fundamental frequency of the voice signal plays an important role in expressing prosodic information, and, strictly speaking, is not periodic, because it contains a high-speed motion. Further, more complicated configurations are present in harmonic components.

Periodic vibration of the glottis modulates expiration to thereby produce a sound-source signal. In the case of ordinary voiced sound, the first derivative of the waveform of the modulated expiration produces discontinuous points periodically. These discontinuous points correspond to opening and closing of the glottis (changeover points sometimes). Since the discontinuous points have high energy in a high-frequency region, they serve as a main excitation source in such a region. Since ripples on the surface of the vocal cords move upon passage of air, the times at which the glottis closes and opens do not necessarily correspond to constant phases which are completely synchronized with vibration of the vocal cords. In the waveform of the modulated air flow, since energy is concentrated at a lower region, the motion of the glottis serves as a main excitation source in the low-frequency region. From these points, it is understood that the instantaneous frequency of each harmonic component is not an accurate integral-multiple of the fundamental frequency.

The above-described observation leads to the following model for voiced sound, which is known to serve as the basis of a sinusoidal-wave model.

$$s(t) = \sum_{k=1}^{N} \sin\left(\int (k\omega_0(t) + \omega_k(t))dt + \phi_k(0)\right) \tag{7}$$

where $\omega_0(t)$ represents the fundamental frequency common among harmonics, and $\omega_k(t)$ represents a deviation of the $k^{th}$ component from the harmonics. $\phi(t)$ represents an initial phase.

This equation suggests that different fundamental frequencies may exist. This is because any one of harmonic components can be used as a reference for calculation of the fundamental frequency. However, there is a large difference between the first component and a component in a high-frequency region. When the main excitation source in the low-frequency region is mere movement of the vocal cords, the main excitation source in the high-frequency region has discontinuous points which depend on both the movement of the vocal cords and wave motion on the surface thereof. Therefore, dependence on the instantaneous frequency of the fundamental frequency component for expressing the fundamental wave component of the voice signal is reasonable, because it can cope with a simple model and is fundamental in actuality.

[2] Estimation of Fundamental Frequency by use of Fixed Points of F-IF Mapping

Since interference caused by components other than the main component is a cause of error produced in calculation of instantaneous frequency, the fundamental frequency component must be separated in order to accurately estimate the fundamental frequency. Filters used for such separation must be designed such that spreading in the frequency and time domains due to filtering is avoided to a possible extent.

A set of filters suitable for such a purpose are provided, the filters exhibiting an impulse response designed from a Gaussian envelope and the base function of a quadratic cardinal B-spline function.

[2-1] Filter Design

In order to avoid distortions in spectrum and time caused by use of filters, each filter must have a high time resolution and a capability of sufficiently eliminating interference from the adjacent harmonic. This is essential for voice signals, because voice signals are essentially non-stationary. The below-described Gabor function composed of a Gaussian envelope minimizes the uncertainty in time-frequency domain and provides a proper compromise in the trade-off between time resolution and frequency resolution. The term "isotropic" means that the time/frequency representation of the function of the wavelength of the carrier has time resolution and frequency resolution comparable to those of the frequency of the carrier.

$$\omega(t) = \frac{1}{\tau_0} e^{-\pi(t/\tau_0)^2} \tag{8}$$

$$W(\omega) = \frac{\tau_0}{\sqrt{2\pi}} e^{-\pi(\omega/\omega_0)^2} \tag{9}$$

where $W(\omega)$ is the Fourier transformation of impulse response $\omega(t)$, and $\omega_0=2\pi f_0$ is the center frequency of the filter.

Through convolution of the base function of a quadratic cardinal B-spline with an isotropic Gaussian envelope function, a quadratic zero point is added to the vicinity of the frequency of the adjacent harmonic in order to suppress interference caused by the adjacent harmonic component.

$$\omega_p(t) = e^{-\pi\left(\frac{t}{\tau_0}\right)^2} * h(t/t0) \tag{10}$$

$$h(t) = \begin{cases} 1-|t| & |t|<1 \\ 0 & \text{otherwise} \end{cases}$$

where * represents convolution.

[2-2] Extraction of Sinusoidal-Wave Component

Assuming that only the dominant sinusoidal-wave signal exists in the effective passband of the filter, the instantaneous frequency of the filter output is determined on the basis of the frequency or $\omega_d$ of the dominant sinusoidal-wave component. In other words, the instantaneous frequency of filter output is substantially the same among the filters which share the common dominant sinusoidal-wave component. The frequency of the sinusoidal-wave component is represented by $\omega_s(t)$. Thus, fixed points are now present in the vicinity of $\omega_s(t)$. The instantaneous frequency of the output of a filter having a center frequency lower than $\omega_s(t)$ is higher than the center frequency. On the other hand, the instantaneous frequency of the output of a filter having a center frequency higher than $w_s(t)$ is lower than the center frequency. Between these two center frequencies, since the output instantaneous frequency changes continuously, there exists a point at which the instantaneous frequency of the filter output coincides with its center frequency, and this point is a fixed point. Since the deviations of the center frequencies of the filters on the upper and lower sides of the fixed point from the frequency of the fixed point can be decreased arbitrarily, the frequency of the fixed point ultimately coincides with $\omega_s(t)$.

The center frequency of a filter is represented by $\lambda$, and the instantaneous frequency of the filter output is represented by $\omega_i(\lambda, t)$. Thus, a set of fixed points defined by the following formula provide candidates for sinusoidal-wave components contained in the signal.

$$\Lambda(t)=\{\lambda|\omega_i(\lambda,t)=\lambda,\omega_i(\lambda-\epsilon,t)-(\lambda_n-\epsilon)>\omega_i(\lambda+\epsilon,t)-(\lambda_n+\epsilon)\} \tag{11}$$

where $\epsilon$ represents an arbitrary small constant.

[3-3] Estimation of Carrier-To-Noise Ratio

When only the dominant sinusoidal-wave component is present in the effective passband, the output instantaneous frequency is completely the same as the frequency of the sinusoidal-wave component. When the background noise is sufficiently low relative to the dominant sinusoidal-wave component, the error of the instantaneous frequency of the filter output in the vicinity of the fixed point is approximated by the weighted sum of background noises represented as sinusoidal-wave components. When the background noise components are assumed to be distributed uniformly in the effective passbands of the filters around the fixed point, the dispersion of errors between the frequency of the dominant sinusoidal-wave component and the instantaneous frequencies of outputs of the filters is proportional to the dispersion of relative errors of the background noises. Notably, the carrier-to-noise ratio is the reciprocal of a value which is the dispersion of relative errors represented in the form of a mean-square error. The dispersion of relative errors of the background noises can be estimated from frequency partial differentiation and time-frequency partial differentiation of the F-IF mapping at the fixed point, by use of the following formula.

Relative error dispersion is represented by $\sigma^2$.

$$\sigma^2 = c_a\left(\frac{\partial\omega_i(t,\lambda)}{\partial\lambda}\right)^2 + c_b\left(\frac{\partial^2\omega_i(t,\lambda)}{\partial t\partial\lambda}\right)^2 \tag{12}$$

$$c_a = \frac{1}{\int\left(\delta\frac{dW_{p(\omega)}}{d\omega}\bigg|_{\omega=\delta}\right)^2 d\delta}$$

$$c_b = \frac{1}{\int\left(\delta^2\frac{dW_p(\omega)}{d\omega}\bigg|_{\omega=\delta}\right)^2 d\delta}$$

where $W_p(\omega)$ represents the Fourier transformation of the filter response $\omega_p(t)$. In actuality, smoothing with respect to time must be introduced in order to obtain an accurate estimation value of relative error dispersion.

[2-4] Selection of Fundamental Frequency Component

In order to allow the system to realize the best compromise between time resolution and frequency resolution, filters must be designed by making use of information regarding the main sinusoidal-wave component to be selected. Further, information regarding the fundamental frequency is needed in order to design the filters for extracting the fundamental frequency. However, such information cannot be used in advance for analysis. A method which can avoid such a difficulty is use of a series of filters having filtering profiles and center frequencies which have been systemically designed.

The series of filters are assumed to have equal frequency intervals on the logarithm frequency axis and the same filtering profile on the logarithm frequency axis. If the interval of the filters is sufficiently small, all fixed points are in reality located at the filter centers. In such a case, a filter covering a fixed point corresponding to the fundamental frequency has the smallest relative error dispersion. This is because other filters naturally include a plurality of harmonic components and noise components in their effective passbands. In other words, the relative error dispersion being smallest proves that the fixed point represents the fundamental frequency component. This manner of advancing the discussion is the same as that used when the present inventor derived the concept of "probability of fundamental wave" in the previous invention. However, the previous technique is based on an intuitively-introduced method of measuring the sum of amplitudes of FM and AM, but is not based on a reliable mathematical base. Further, since the relative error dispersion corresponds directly to estimation errors of frequency, use of the relative error dispersion is more appropriate.

On the basis of the above-described discussion, the procedure for selecting the fundamental frequency component without use of advance information regarding F0 can be summarized as follows.

Step 1: Prepare a series of filters having center frequencies separated at equal intervals along the logarithm frequency axis. The center frequencies must cover a range in which F0 may appear (i.e., 40 Hz to 800 Hz). The intervals must be sufficiently small (i.e., 24 filters per octave).

Step 2: Feed a signal to be analyzed to the prepared filters.

Step 3: Calculate the instantaneous frequency of each filter output.

Step 4: Extract fixed points while using a selection criterion (formula (11)).

Step 5: Calculate the relative error dispersion of each fixed point (formula (12)).

Step 6: In each analysis frame, select a fixed point having the smallest relative error dispersion. The thus-selected fixed point is the leading candidate for the fundamental frequency component.

The fundamental frequency is estimated as an instantaneous frequency of the extracted fundamental frequency component.

In actuality, the final step for selecting the fundamental frequency component sometimes fails to select the fundamental frequency component; the relative error dispersion corresponding to the fundamental frequency component does not decrease sufficiently, due to the influence of a high-pass filter inserted to prevent influence of environmental noise at the time of recording and the influence of deterioration of the signal-to-noise ratio at low frequency. The problem of these influences can be mitigated by obtaining an F0 locus from a portion where the relative error dispersion is sufficiently small and by extending the F0 locus while pursuing continuity with the preceding and succeeding portions.

[2-5] Interference Produced by Non-Dominant Sinusoidal-Wave Components

The output signal of a filter whose center frequency corresponds to one dominant sinusoidal-wave component can be approximated by the following equation. Assuming that $\epsilon<<1$, $$s(t) = g(\omega-\omega_h)e^{j\omega_h t} + \varepsilon g(\omega-\omega_h+\delta)e^{j(\omega_h+\delta)t} \tag{13}$$

$$= e^{j\omega_h t} g(\omega-\omega_h)\left(1 + \frac{\varepsilon g(\omega-\omega_h+\delta)}{g(\omega-\omega_h)} e^{j\delta t}\right) \tag{14}$$

$g(\omega)$ is assumed to have a maximal value of 1 at $\omega=1$. Also, it is assumed that the frequency-domain weight function $g(\omega)$ is a smooth, continuous function and that no singular points are present in the vicinity of $\omega=0$. In this case, it is understood that the Taylor expansion of $g(\omega)$ in the vicinity of 0 is such that if $\omega<<1$, $g(\omega)\approx 1$. When these assumptions are used, the above-described formula (14) can be approximated as follows.

$$s(t) \simeq e^{j\omega_h t}(1+\epsilon g(\omega-\omega_h+\delta)e^{j\delta t}) \tag{15}$$

Here, in order to investigate the instantaneous frequency, this equation must be rewritten in polar form.

$$\begin{aligned} s(t) &\simeq e^{j\omega_h t}(1+\varepsilon g(\omega-\omega_h+\delta)e^{j\delta t}) \\ &= \sqrt{1+2\varepsilon g(\omega-\omega_h+\delta)\cos\delta t+\varepsilon^2 g^2(\omega-\omega_h+\delta)}\, e^{\left(j\tan^{-1}\frac{\varepsilon g(\omega-\omega_h+\delta)\sin\delta t}{1+\varepsilon g(\omega-\omega_h+\delta)\cos\delta t}\right)} e^{j\omega_h t} \end{aligned} \tag{16}$$

Since it is assumed that $\omega<<1$ and $\epsilon<<1$, the equation can be approximated further.

$$\begin{aligned} s(t) &\simeq (1+\varepsilon g(\omega-\omega_h+\delta)\cos\delta t)e^{(j\tan^{-1}\varepsilon g(\omega-\omega_h+\delta)\sin\delta t)}e^{j\omega_h t} \\ &\simeq (1+\varepsilon g(\omega-\omega_h+\delta)\cos\delta t)e^{j\varepsilon g(\omega-\omega_h+\delta)\sin\delta t}e^{j\omega_h t} \\ &= (1+\varepsilon g(\omega-\omega_h+\delta)\cos\delta t)e^{j\omega_h t+j\varepsilon g(\omega-\omega_h+\delta)\sin\delta t} \end{aligned} \tag{17}$$

The phase function $\phi(t)$ of the signal $s(t)$ is approximated as follows.

$$\phi(t) \simeq \omega_h t+\epsilon g(\omega-\omega_h+\delta)\sin\delta t \tag{18}$$

This indicates that phase modulation is caused by interference signals.

The instantaneous frequency $\omega_i(t)$ of the signal $s(t)$ can be derived from the time derivative of a phase function, as follows.

$$\begin{aligned} \omega_i(t) &= \frac{d\phi(t)}{dt} \\ &\simeq \frac{d}{dt}(\omega_h t+\varepsilon g(\omega-\omega_h+\delta)\sin\delta t) \\ &= \omega_h(t) + t\frac{d\omega_h(t)}{dt} + \varepsilon\delta g(\omega-\omega_h+\delta)\cos\delta t \end{aligned} \tag{19}$$

[2-6] Practical Method for Estimating Carrier-To-Noise Ratio

A value to be obtained here is the carrier-to-noise ratio of the sinusoidal-wave component under consideration. The carrier-to-noise ratio is desirably calculated on the basis of instantaneous values only. In other words, the average value of $\epsilon$ within the passband of a specific bandpass filter is used. That is, the basic idea is to obtain a method of eliminating sinusoidal-wave variation at $\omega_i(t)$ by making use of the relation $\sin^2+\cos^2=1$. The geometrical attribute at the fixed point serves as a key for achieving this.

[2-6-1] Frequency Partial Differentiation

The following formula can be obtained through partial differentiation of the instantaneous frequency $\omega_i(t)$ with respect to frequency.

$$\begin{aligned} \frac{\partial\omega_i(t,\omega)}{\partial\omega} &\simeq \frac{\partial}{\partial\omega}\left(\omega_h(t) + t\frac{d\omega_h(t)}{dt} + \varepsilon\delta g(\omega-\omega_h+\delta)\cos\delta t\right) \\ &= \left(\frac{\partial g(\omega-\omega_h+\delta)}{\partial\omega}\right)\varepsilon\delta\cos\delta t \\ &= \left(\frac{dg(\omega-\omega_h+\delta)}{d\omega}\right)\varepsilon\delta\cos\delta t \\ &= \left.\frac{dg(\omega)}{d\omega}\right|_{\omega=\delta}\varepsilon\delta\cos\delta t \end{aligned} \tag{20}$$

When a single component causes interference, the value of $\epsilon$ can be estimated through observation over a single period which is determined by $t_0=2\pi/\delta$. However, in general, a plurality of interfering components can exist simultaneously.

[2-6-2] Time-Frequency Partial Differentiation

It seems reasonable to obtain a signal of a sine phase corresponding to the previous signal having a cosine phase through partial differentiation with respect to time.

$$\begin{aligned} \frac{\partial\omega_i(t,\omega)}{\partial t} &\simeq \frac{\partial}{\partial t}\left(\omega_h(t) + t\frac{d\omega_h(t)}{dt} + \varepsilon\delta g(\omega-\omega_h+\delta)\cos\delta t\right) \\ &= \frac{d\omega_h(t)}{dt} + \frac{d\omega_h(t)}{dt} + t\frac{d^2\omega_h(t)}{dt^2} - \\ &\quad \varepsilon\delta^2 g(\omega-\omega_h+\delta)\sin\delta t \\ &= 2\frac{d\omega_h(t)}{dt} + t\frac{d^2\omega_h(t)}{dt^2} - \varepsilon\delta^2 g(\omega-\omega_h+\delta)\sin\delta t \end{aligned} \tag{21}$$

The sine phase variable is obtained as the third term. However, in the case of voice or a similar signal, the fundamental frequency varies at high speed, and information regarding the variation cannot be obtained in advance. Therefore, the first two terms cannot be removed.

The next step is partial differentiation of equation (21) with respect to frequency. This is performed as follows.

$$\frac{\partial^2\omega_i(t,\omega)}{\partial t\partial\omega} \simeq \frac{\partial}{\partial\omega}\left(2\frac{d\omega_h(t)}{dt} + t\frac{d^2\omega_h(t)}{dt^2} - \right. \tag{22}$$

-continued $$\varepsilon\delta^2 g(\omega-\omega_h+\delta)\sin\delta t\Big)$$

$$=-\left(\frac{dg(\omega-\omega_h+\delta)}{d\omega}\right)\varepsilon\delta^2\sin\delta t$$

$$=-\frac{dg(\omega)}{d\omega}\bigg|_{\omega=\delta}\varepsilon\delta^2\sin\delta t$$

This equation consists of only components which vary with the sine phase.

[3] Specific Examples will now be Described.

An example analysis performed by use of an artificial signal and an example analysis performed by use of an actual voice sample will be described.

[3-1] Impulse Series Having Additional White Noise

Figure 2:
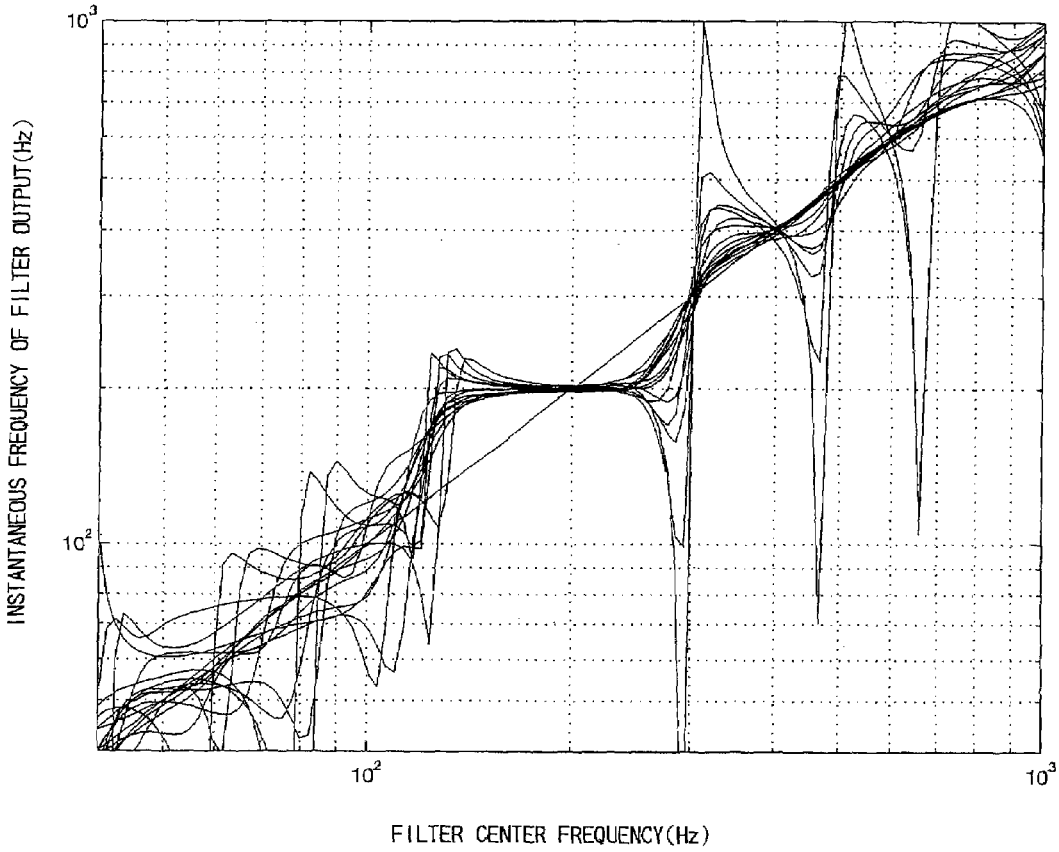
FIG. 2 is a graph relating to the embodiment of the present invention and showing mapping from filter center frequency to output instantaneous frequency.

FIG. 2 shows mapping from filter center frequency to output instantaneous frequency. A composite signal consisting of a pulse series of 200 Hz and white noise (S/N: 20 dB) is analyzed by use of filters disposed at equal intervals along the logarithm frequency axis. It is to be noted that the instantaneous frequency in the vicinity of a fixed point corresponding to 200 Hz is constant. Other fixed points do not exhibit such stability.

FIG. 3 shows intermediate values of variables used in calculation of a carrier-to-noise ratio and results finally obtained. The square roots of these values are plotted in FIG. 3. It is to be noted that a phase difference of $\pi/2$ is properly introduced between the frequency partial differentiation indicated by the solid line and the time-frequency partial differentiation indicated by the broken line. Further, it is understood that a sharp dip attributable to interference between component sinusoidal waves is produced in the weighted root-mean squares of the frequency partial differentiation and the time-frequency partial differentiation. Through application of the above-described smoothing to the weighted root-mean squares, a smooth estimation value of the carrier-to-noise ratio can be obtained.

Figure 4:
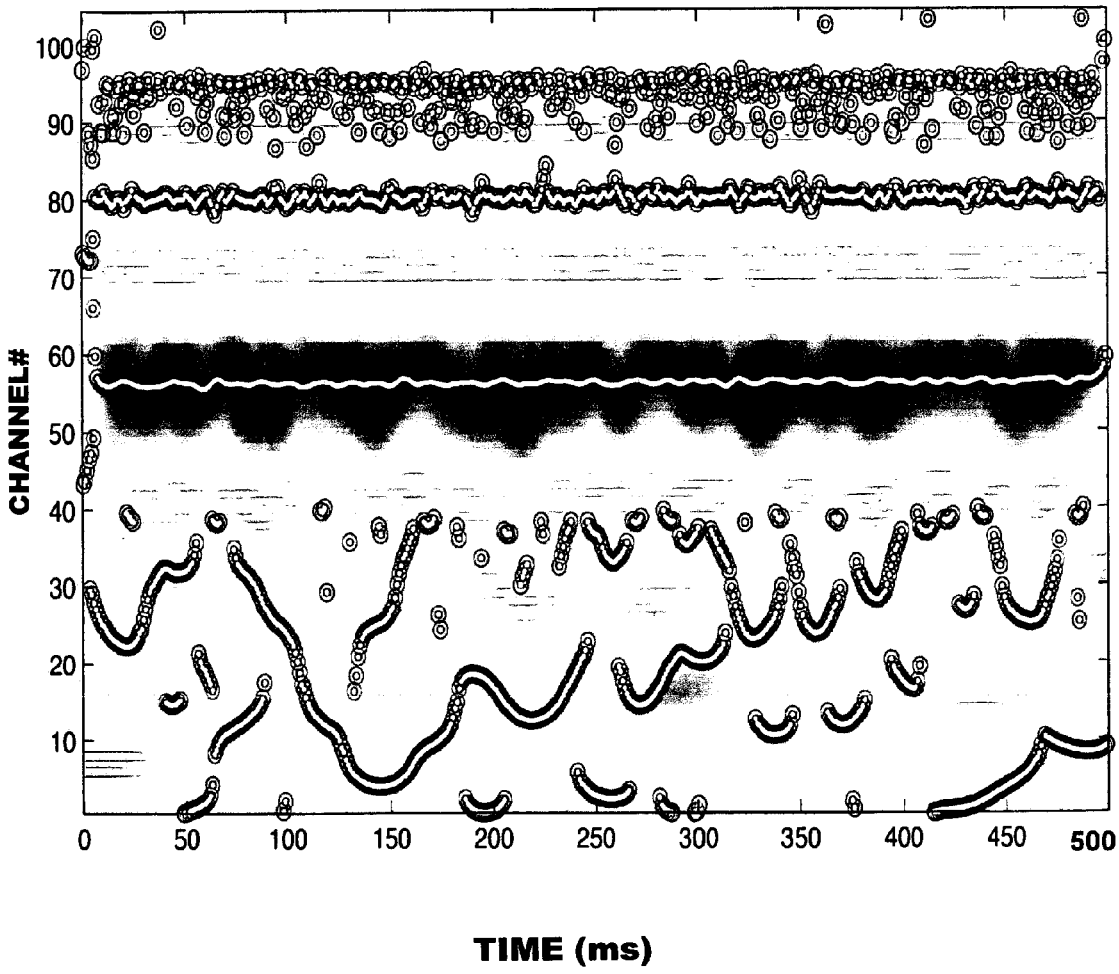
FIG. 4 is a photograph relating to the embodiment of the present invention and showing distributions of carrier-to-noise ratios and fixed points on a time-channel plane.

FIG. 4 is an image showing variation in the carrier-to-noise ratio with time and frequency (time and channel number). Further, obtained fixed points are shown in FIG. 4 such that they are superposed on the image. In FIG. 4, the darkness corresponds to the carrier-to-noise ratio. The darker a point, the greater the carrier-to-noise ratio.

All the extracted fixed points in the vicinity of 200 Hz correspond to the fundamental frequency component. No other fixed point is located in the vicinity of 200 Hz. In the region of less than 100 Hz, the extracted fixed points are distributed randomly, and there is only a weak trend that they approach one another. In a higher frequency region, the fixed points tend to stay at corresponding harmonic frequencies.

Figure 5:
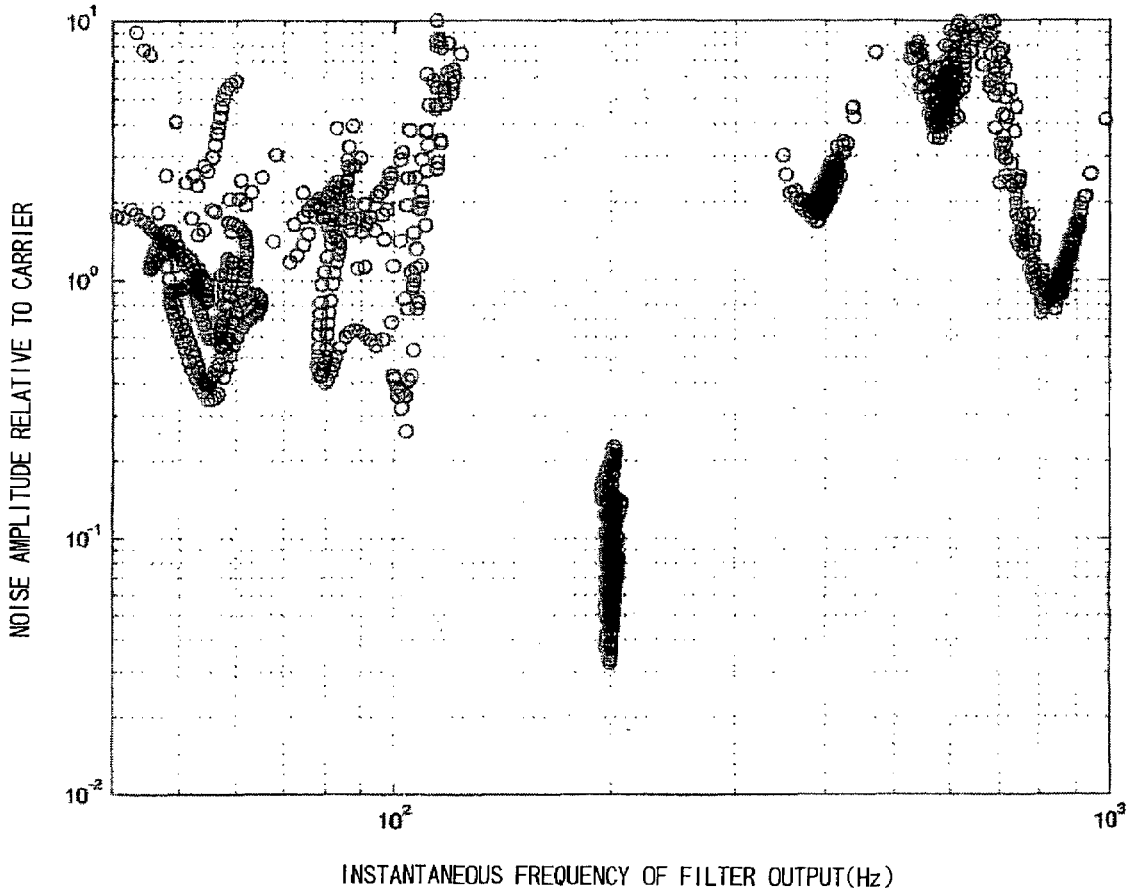
FIG. 5 is a graph relating to the embodiment of the present invention and showing distribution of fixed points with respect to instantaneous frequency of filter output and carrier-to-noise ratio.

FIG. 5 shows the distribution of the fixed points on a plane spanned by instantaneous frequency and carrier-to-noise ratio. The fixed points corresponding to the fundamental component are clearly distinguishable. It is to be noted that the carrier-to-noise ratios of the fixed points in the vicinity of harmonic frequencies become maximum at the respective harmonic frequencies. The reason why such a phenomenon occurs is that the degree of the mutual interference increases considerably when adjacent harmonic components are mixed in substantially equal proportions.

Figure 6:
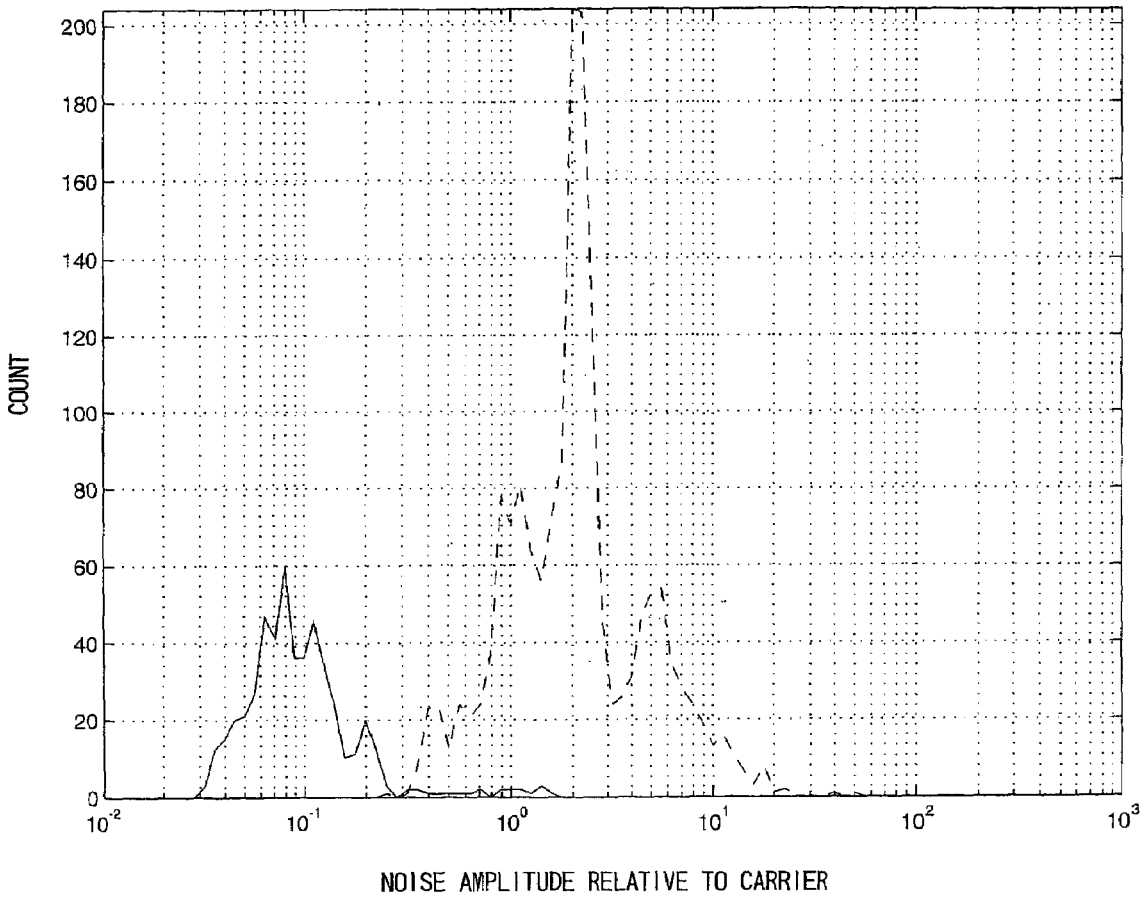
FIG. 6 is a graph relating to the embodiment of the present invention and showing frequency distribution of carrier-to-noise ratios.

FIG. 6 shows the distribution of carrier-to-noise ratios of the minimal point and that of the remaining points. It is understood that the fixed points corresponding to the fundamental frequency component have a distribution which is clearly distinguishable.

[3-2] Continuous Vowel

Figure 7:
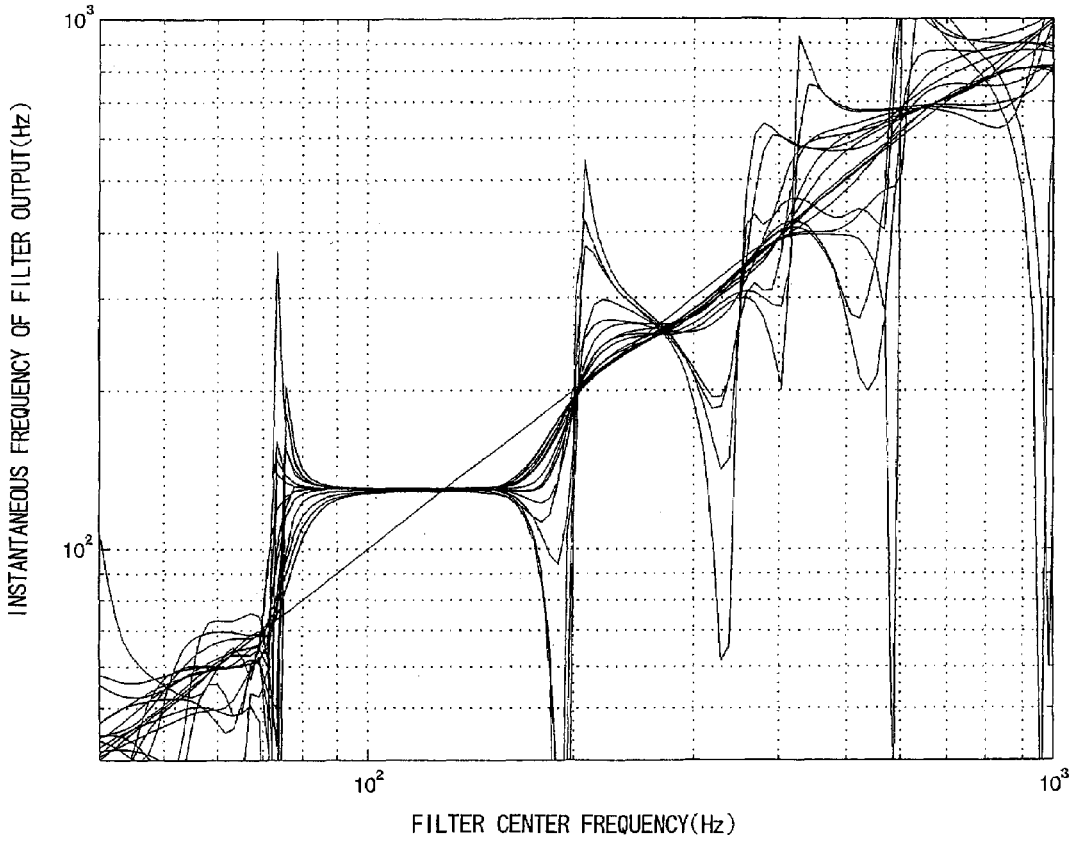
FIG. 7 is a graph relating to the embodiment of the present invention and showing mapping from filter center frequency to output instantaneous frequency.

FIG. 7 shows mapping from center frequency to instantaneous frequency in the case in which a Japanese vowel "a" continuously produced by an adult male speaker was used as an input signal. The speaker was instructed to maintain a constant fundamental frequency (about 130 Hz) during the continuous production of the vowel. The sampling frequency of the signal was 22050 Hz, and the quantization bit number was 16 bits. As in the case of the pulse series, the mapping is substantially flat in the vicinity of a fixed point corresponding to the fundamental frequency.

FIG. 8 shows the distribution of the fixed points on a plane spanned by instantaneous frequency and carrier-to-noise ratio. The fixed point corresponding to the fundamental component is located in the vicinity of 130 Hz.

Figure 9:
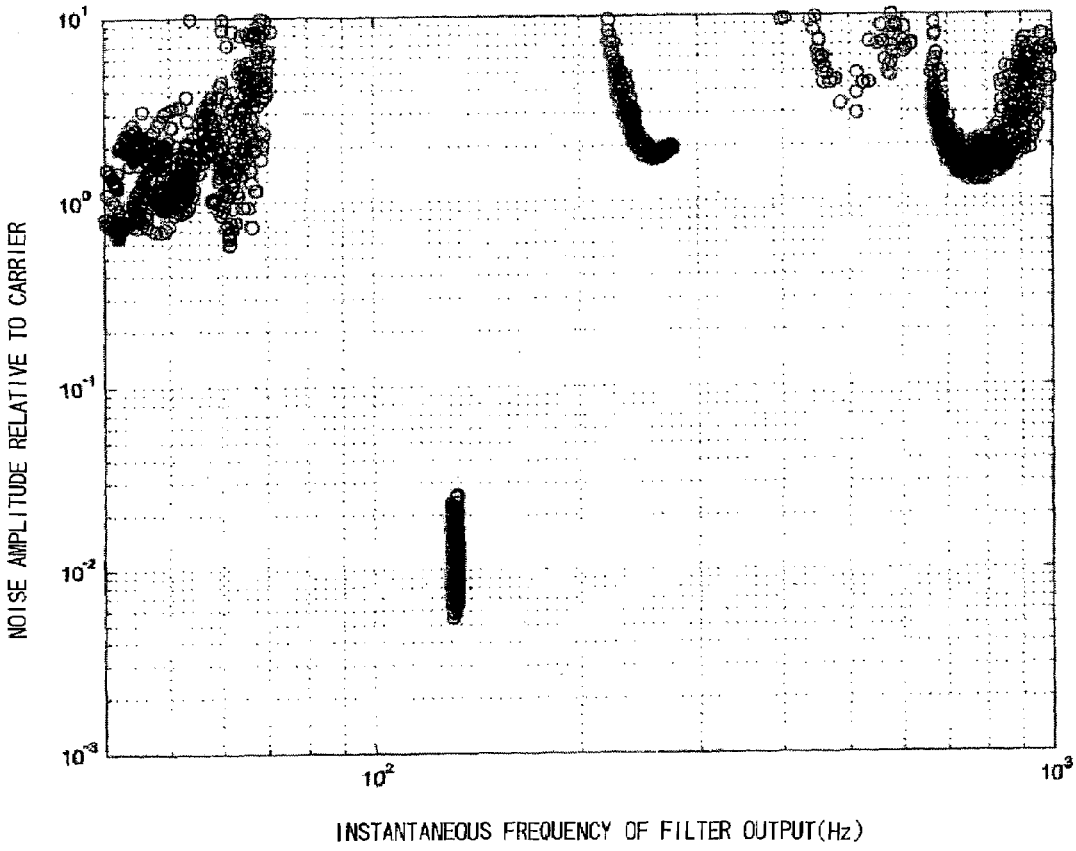
FIG. 9 is a graph relating to the embodiment of the present invention and showing distribution of fixed points with respect to instantaneous frequency of filter output and carrier-to-noise ratio.

FIG. 9 shows the dispersion of the fixed points on a plane spanned by instantaneous frequency and carrier-to-noise ratio. It is clear from FIG. 9 that the fixed points in the vicinity of fundamental frequency have very low carrier-to-noise ratio. As in the case of the pulse series, the carrier-to-noise ratios of the fixed points in the vicinity of harmonic frequencies become maximum at the respective harmonic frequencies. The carrier-to-noise ratio of the fundamental frequency component is about 40 dB, which indicates that the F0 of the continuous vowel is very stable.

Figure 10:
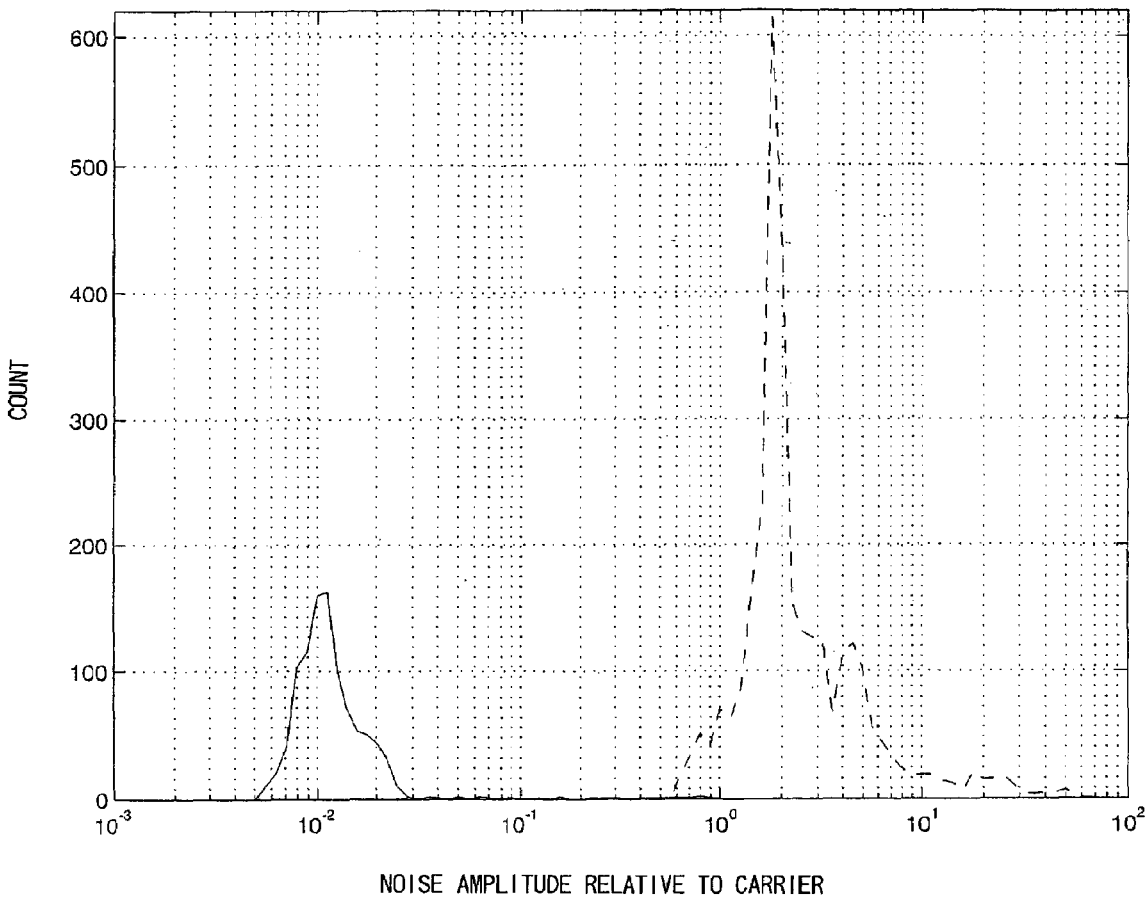
FIG. 10 is a graph relating to the embodiment of the present invention and showing frequency distribution of carrier-to-noise ratios.

FIG. 10 shows the frequency distribution of the same data. From FIG. 10, it is apparent that the distributions are separated from each other.

[3-3] Vowel Chain Having a Natural Prosody

Figure 11:
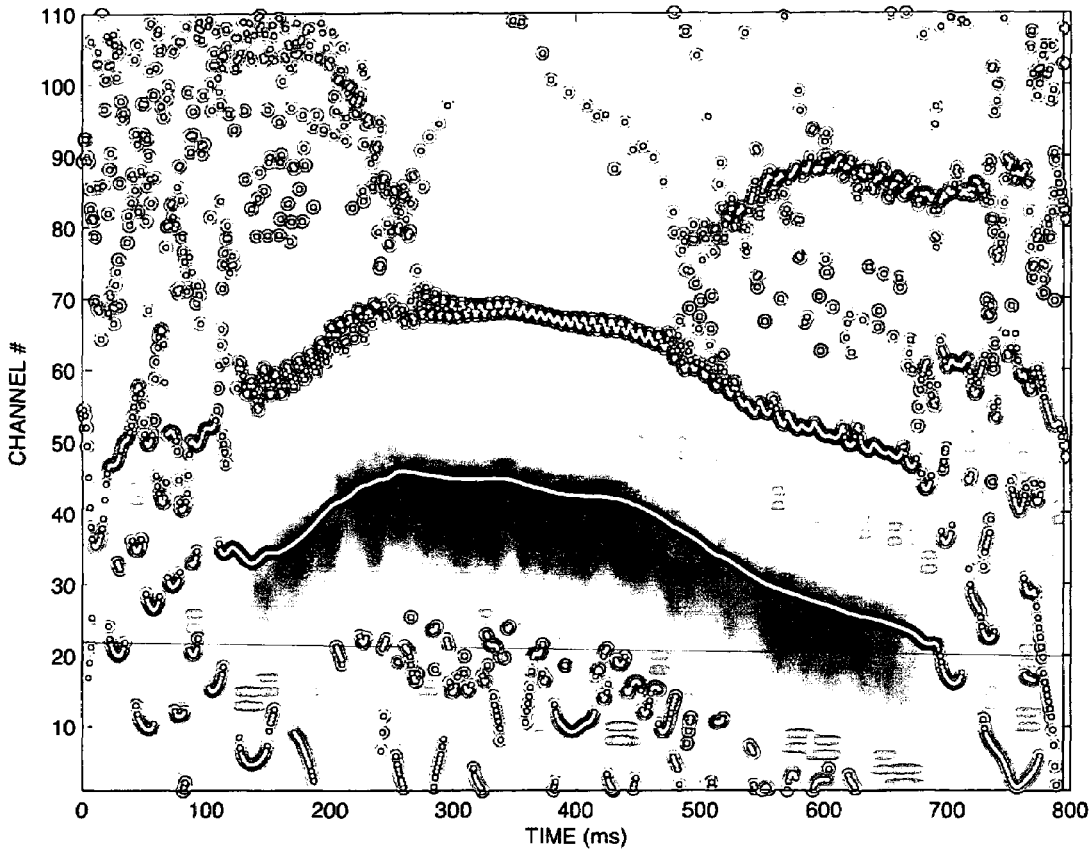
FIG. 11 is a photograph relating to the embodiment of the present invention and showing distributions of carrier-to-noise ratios and fixed points on a time-channel plane.

FIG. 11 shows the time-frequency distribution of fixed points extracted from a vowel chain continuously produced by an adult male speaker. As in the case of the previous results, a locus corresponding to the fundamental frequency component is clearly shown as a smoothly connected cluster of fixed points. The fixed points corresponding to the first Formant are clearly shown around 500 ms to 700 ms.

Figure 12:
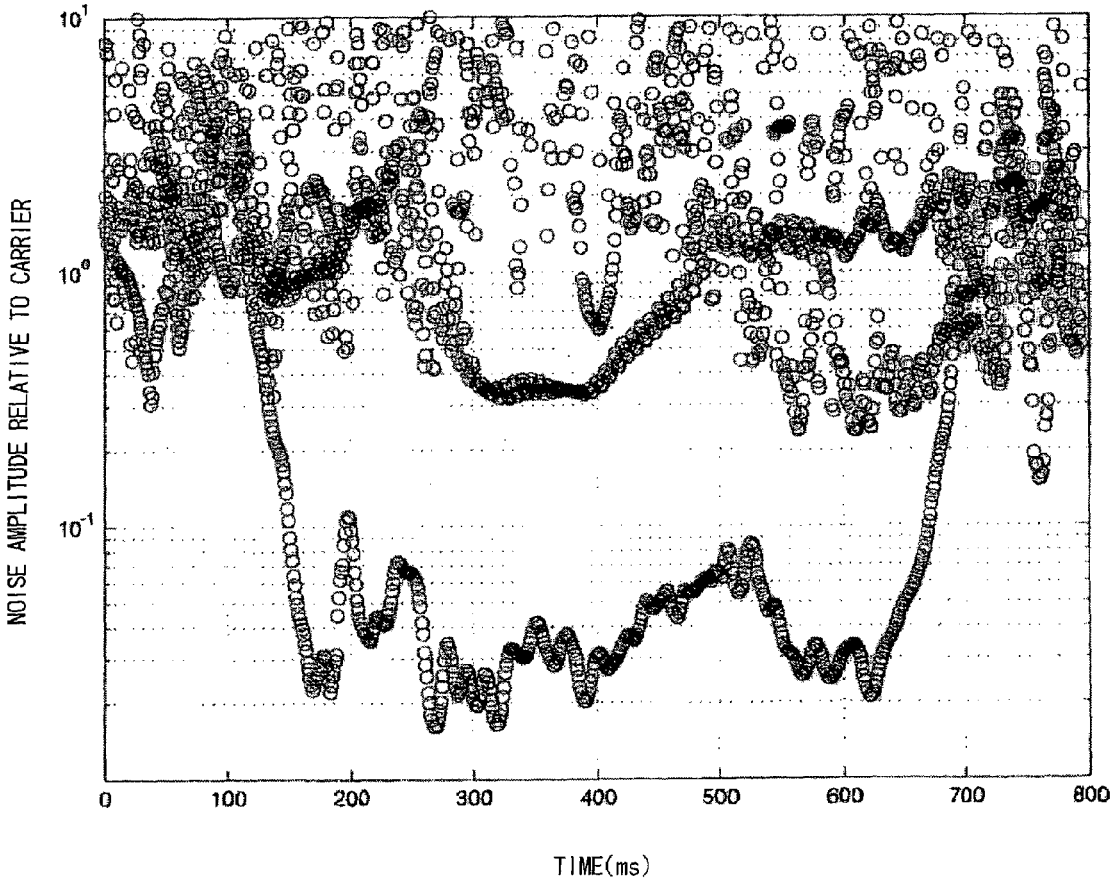
FIG. 12 is a graph relating to the embodiment of the present invention and showing temporal distribution of noise amplitude relative to carrier.

FIG. 12 shows temporal variation of the carrier-to-noise ratios of the fixed points. From FIG. 12, a portion corresponding to a voiced sound is clearly distinguished. In the voiced sound portion, only the fundamental frequency component exhibits a sufficiently high carrier-to-noise ratio.

Figure 13:
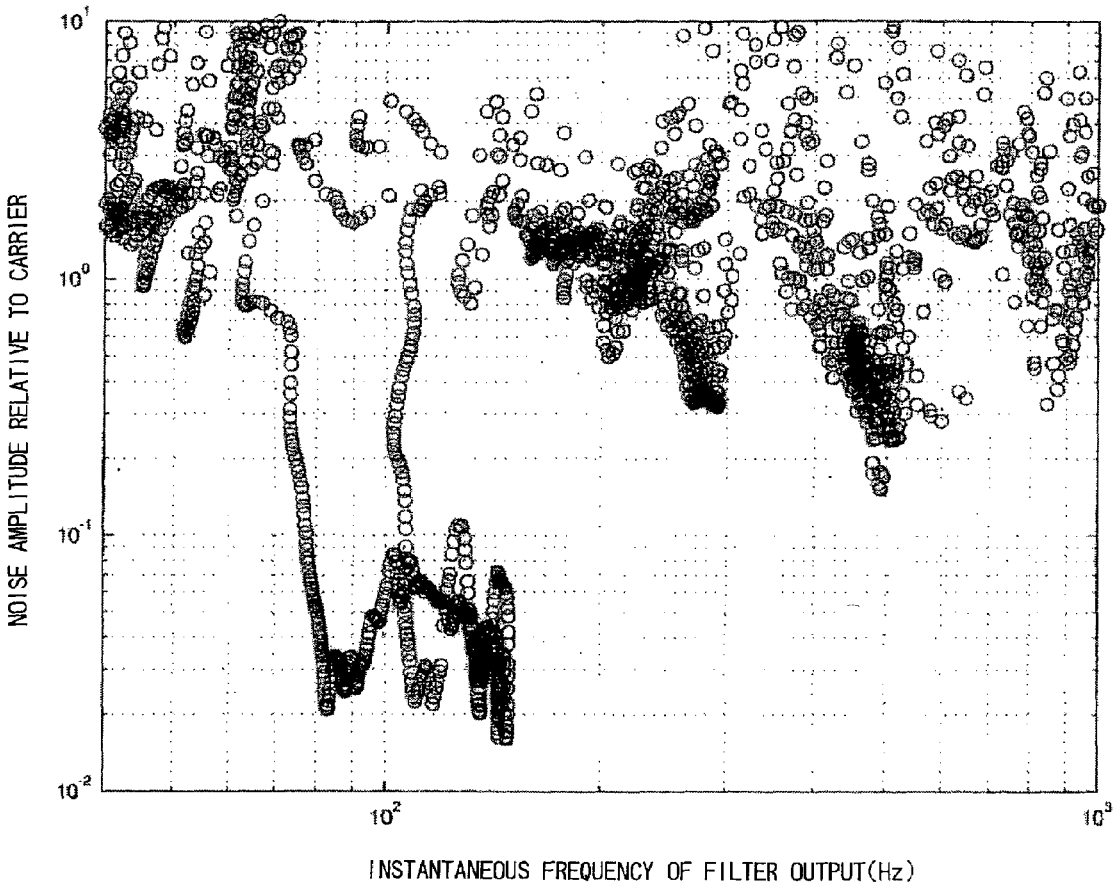
FIG. 13 is a graph relating to the embodiment of the present invention and showing distribution of fixed points with respect to instantaneous frequency of filter output and carrier-to-noise ratio.

FIG. 13 shows the distribution of the fixed points on a plane spanned by instantaneous frequency and carrier-to-noise ratio. When FIG. 13 and FIG. 11 are considered in combination, it is found that use of a look-ahead buffer enables easy realization of a reliable F0 tracking algorithm.

[3-4] Sentence Database Using Simultaneous EGG Recording

Figure 14:
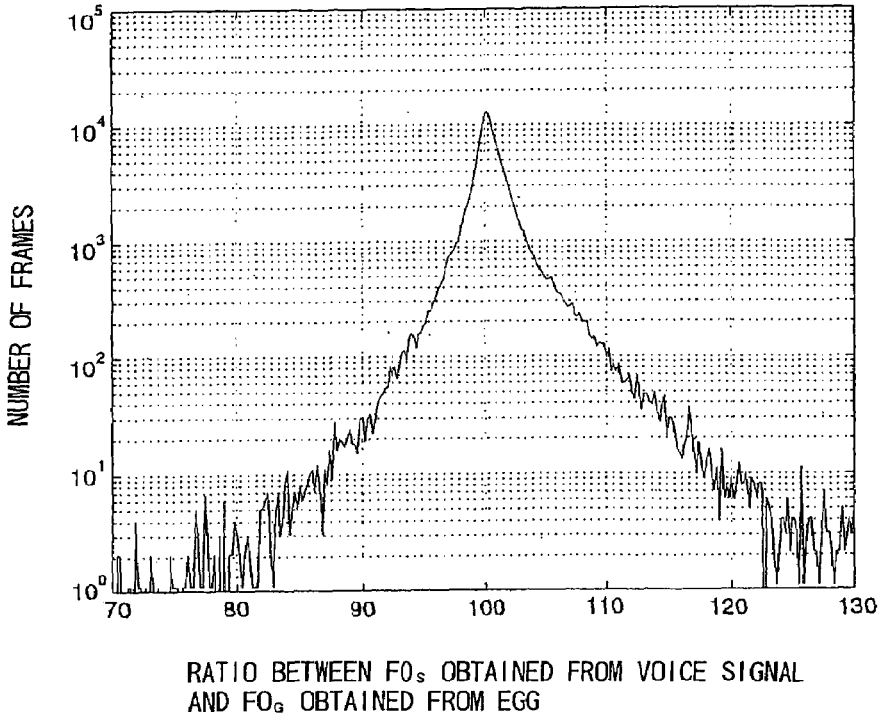
FIGS. 14(*a*) and 14(*b*) are graphs relating to the embodiment of the present invention and showing distribution of F0-estimation errors.
Figure 14:
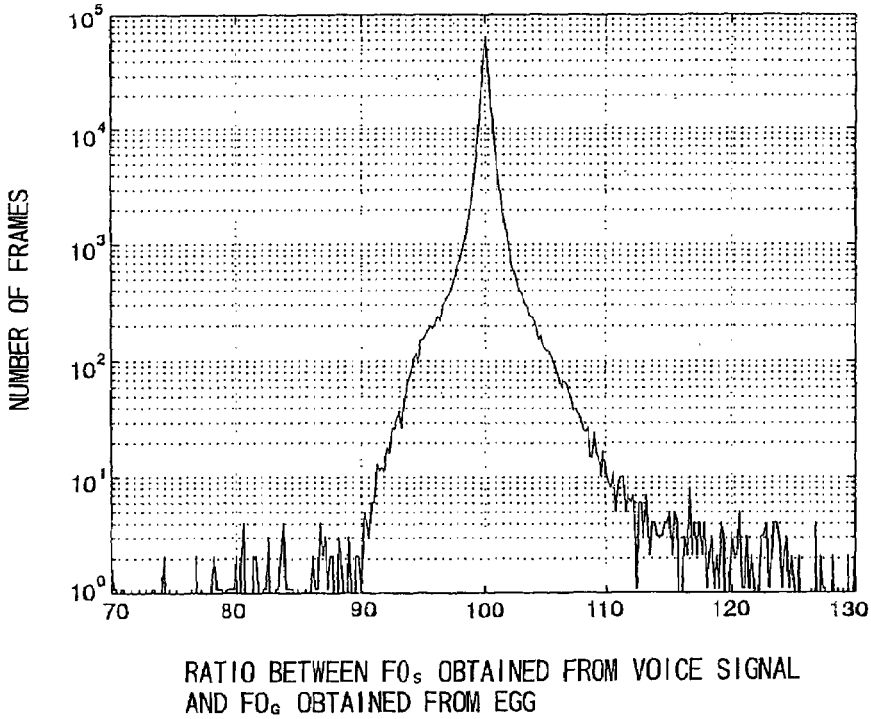

FIGS. 14(*a*) and 14(*b*) each show distribution of errors in fundamental frequency estimation. The horizontal axis represents the percent ratio between F0 obtained from a voice signal and F0 obtained from an EEG signal. The position of 100% on the horizontal axis corresponds to the case in which the error is zero. FIG. 14(*a*) shows errors in fundamental frequency estimation for the case of an adult male speaker, and FIG. 14(*b*) shows errors in fundamental frequency estimation for the case of an adult female speaker. From these graphs, it is understood that the errors in the case of an adult male speaker are greater than those in the case of an adult female speaker.

Table 1 shows statistics of errors in fundamental frequency extraction. A very good result was obtained, although the result involves errors in analyzing the EGG signal. This result can be regarded as an upper limit of the performance of the method for estimating F0 on the basis of fixed points, for the case in which only the fundamental frequency component is used. A satisfactory result can be obtained for the adult female's data, but a further improvement is necessary for the adult male's data. The portion surrounded by the broken line B in FIG. 1 is used in order to improve estimation results in such a case.

| | NUMBER OF FRAMES | ADULT MALE (RATIO TO ALL FRAMES: %) |
|---|---|---|
| TOTAL NUMBER OF FRAMES | 156102 | |
| ERROR OF 20% OR HIGHER | 712 | (0.4561%) |
| ERROR OF 5% OR HIGHER | 10963 | (7.023%) |
| ERROR OF 1% OR HIGHER | 64926 | (41.59%) |
| HALF-PITCH ERROR | 63 | (0.04036%) |
| DOUBLE-PITCH ERROR | 281 | (0.18%) |
| TOTAL NUMBER OF FRAMES | 249641 | |
| ERROR OF 20% OR HIGHER | 181 | (0.0725%) |
| ERROR OF 5% OR HIGHER | 2577 | (1.032%) |
| ERROR OF 1% OR HIGHER | 26111 | (10.46%) |
| HALF-PITCH ERROR | 46 | (0.01843%) |
| DOUBLE-PITCH ERROR | 18 | (0.00721%) |

Note: % indicates ratio to all frames.

The present invention is not limited to the above-described embodiments. Numerous modifications and variations of the present invention are possible in light of the spirit of the present invention, and they are not excluded from the scope of the present invention.

As have been described in detail, the present invention achieves the following effects.

(A) Sinusoidal-wave components can be extracted reliably from a signal, and the influences of the extracted components can be obtained quantitatively from values observed within a short time.

(B) High-quality sound-source information (information regarding fundamental frequency and periodicity) for analytically synthesizing voice can be extracted.

(C) In analysis of sound having periodicity, such as sound produced by a musical instrument, the probability of periodicity can be obtained as an objective index. Therefore, the analysis result can be used as high-quality sound-source information used for conversion and synthesis of musical-instrument sound. Further, the method of the present invention can be used in a general-purpose analyzer in order to analyze periodicity of ordinary signals.

(D) Since values which can clearly be interpreted quantitatively are obtained, there can be effectively integrated results obtained by use of filters having different configurations, such as a result obtained by use of a logarithm-frequency-axis analogous filter and that obtained by use of a linear-frequency-axis analogous adapted chirp filter.

(E) Carrier-to-noise-ratio evaluation values can be used as they are for evaluating bandpass filters or results of frequency analysis.

INDUSTRIAL APPLICABILITY

The method of extracting sound-source information according to the present invention can be applied not only to all fields in which voice analysis is needed, and but also to a wide range of general audio media, such as application to electronic musical instruments.

What is claimed is:

1. A method of extracting sound-source information by use of fixed points of mapping from frequency to instantaneous frequency, comprising:

performing partial differentiation of instantaneous frequency of each filter with respect to frequency to thereby obtain a first value;

performing partial differentiation of output of each filter with respect to frequency and then with respect to time to thereby obtain a second value; and imparting proper weights to the first and second values and performing short-time weighted integration with respect to time to thereby estimate a carrier-to-noise ratio of each filter, whereby a carrier-to-noise ratio is obtained, and an estimated value of evaluation value is obtained.

2. A method of extracting sound-source information according to claim 1, wherein on the basis of the evaluation value estimated by use of the carrier-to-noise ratio, a logarithm-frequency-axis analogous filter is used for selection of a fixed point corresponding to a fundamental frequency, and the fundamental frequency is extracted without advance information regarding the fundamental frequency.

3. A method of extracting sound-source information according to claim 2, wherein the logarithm-frequency-axis analogous filter and a linear-frequency-axis analogous adapted chirp filter are used in combination in order to extract the fundamental frequency without advance information regarding the fundamental frequency and to improve the accuracy of the extracted fundamental frequency.

4. An apparatus for extracting sound-source information by use of fixed points of mapping from frequency to instantaneous frequency, comprising:

means for performing partial differentiation of instantaneous frequency of each filter with respect to frequency to thereby obtain a first value;

means for performing partial differentiation of output of each filter with respect to frequency and then with respect to time to thereby obtain a second value; and means for imparting proper weights to the first and second values and performing short-time weighted integration with respect to tire to thereby estimate a carrier-to-noise ratio of each filter, whereby a carrier-to-noise ratio is obtained, and an estimated value of evaluation value is obtained.

5. An apparatus for extracting sound-source information according to claim 4, further comprising a logarithm-frequency-axis analogous filter for selection of a fixed point corresponding to a fundamental frequency on the basis of the evaluation value estimated by use of the carrier-to-noise ratio, and means for extracting the fundamental frequency without advance information regarding the fundamental frequency.

6. An apparatus for extracting sound-source information according to claim 5, wherein the logarithm-frequency-axis analogous filter and a linear-frequency-axis analogous adapted chirp filter are used in combination in order to extract the fundamental frequency without advance information regarding the fundamental frequency and to improve the accuracy of the extracted fundamental frequency.

* * * * *

UNITED STATES PATENT AND TRADEMARK OFFICE

CERTIFICATE OF CORRECTION

PATENT NO. : 7,085,721 B1
APPLICATION NO. : 09/786642
DATED : August 1, 2006
INVENTOR(S) : Hideki Kawahara et al.

It is certified that error appears in the above-identified patent and that said Letters Patent is hereby corrected as shown below:

On the Title Page

"Assignee: Advanced Telecommunications Research Institute International (JP)"
Should read:

-- Assignee: Advanced Telecommunications Research Institute International (JP); and Japan Science and Technology Corporation (JP) --

Under the heading "OTHER PUBLICATIONS", line 16, "Armin" should read -- Amin --.

Column 18, line 47 (claim 4, line 12), "tire" should read -- time --.

Signed and Sealed this

Twenty-fifth Day of December, 2007

JON W. DUDAS
*Director of the United States Patent and Trademark Office*